United States Patent [19]

Kuge et al.

[11] Patent Number: 4,482,240

[45] Date of Patent: Nov. 13, 1984

[54] ELECTROPHOTOGRAPHIC PROCESS UTILIZING ELECTROSTATIC SEPARATION AND APPARATUS THEREFOR

[75] Inventors: Tsukasa Kuge; Koichi Tanigawa; Hiroyuki Adachi, all of Tokyo, Japan

[73] Assignee: Canon Kabushiki Kaisha, Tokyo, Japan

[21] Appl. No.: 388,153

[22] Filed: Jun. 14, 1982

[30] Foreign Application Priority Data

Jun. 24, 1981 [JP] Japan ..... 56-97912
Jun. 25, 1981 [JP] Japan ..... 56-98959

[51] Int. Cl.[3] ..... G03G 15/00

[52] U.S. Cl. ..... 355/3 TR; 355/3 SH; 355/14 TR

[58] Field of Search ..... 355/14 SH, 3 SH, 3 TR, 355/14 TR, 133; 271/307, 310, DIG. 1; 430/97, 100, 55; 400/582

[56] References Cited

U.S. PATENT DOCUMENTS 3,357,400 12/1967 Manghirmalani ..... 118/637
3,575,502 4/1971 Eppe ..... 355/3
3,870,515 3/1975 Kaupp ..... 96/1.4
3,998,536 12/1976 Kaupp ..... 355/3
4,077,709 3/1978 Borostyan et al. ..... 355/3 TR
4,275,968 6/1981 Irwin ..... 400/582
4,286,032 8/1981 Ito et al. ..... 430/55
4,341,457 7/1982 Nakahata et al. ..... 366/3 CH
4,353,648 10/1982 Tanaka et al. ..... 355/14 SH X
4,402,591 9/1983 Nakahata ..... 355/3 TR

*Primary Examiner*—A. C. Prescott
*Attorney, Agent, or Firm*—Cella, Harper & Scinto Fitzpatrick

[57] ABSTRACT

An electrophotographic process includes the steps of forming a visible image composed of coloring particles on a photosensitive member having a surface insulating layer, providing the visible image with an electrostatic charge by first corona discharge, bringing a transfer sheet into contact with the photosensitive member, providing the rear surface of the transfer sheet with a predetermined amount of an electrostatic charge of a polarity opposite to that of the charge on the coloring particles by second corona discharge thereby transferring the visible image onto the transfer sheet, and providing the rear surface of the transfer sheet with an electrostatic charge, which is the same in polarity as that of the coloring particles but is less in the amount than that provided by the second corona discharge, thereby separating the transfer sheet from the photosensitive member, and an apparatus adapted for executing the above-mentioned process.

16 Claims, 13 Drawing Figures

ELECTROPHOTOGRAPHIC PROCESS UTILIZING ELECTROSTATIC SEPARATION AND APPARATUS THEREFOR

BACKGROUND OF THE INVENTION

1. Field of the Invention

The present invention relates to an electrophotographic process utilizing electrostatic separation and an apparatus therefor.

2. Description of the Prior Art

There are already known various electrophotographic apparatus for forming an image corresponding to an original image, utilizing an image bearing member such as a photosensitive drum or an insulating drum. For example, in electrostatic copiers, a visible image corresponding to an original image if formed by process on a drum- or belt-shaped photosensitive member, and is then transferred onto a transfer sheet to obtain a final copy. For such image transfer there is known the so-called electrostatic separating method, in which corona discharge of a polarity opposite to that of the charge retained by the image-constituting coloring particles (hereinafter called toner) is applied to the rear face of the transfer sheet, thereby depositing the toner on the transfer sheet by the electrostatic attractive force, and the charge on the rear face of the transfer sheet is subsequently dissipated for example by corona discharge to separate the transfer sheet from the photosensitive member by means of the rigidity or weight of the transfer sheet itself.

Conventionally, such electrostatic separating process has only been applicable to electrophotographic processes utilizing a two-layered photosensitive member composed of a photoconductive layer and a conductive substrate, such as disclosed in the U.S. Pat. Nos. 3,357,400, 3,575,502, 3,870,515 and 3,998,536. Such method has not been practically applicable to a three-layered photosensitive member composed of a surfacial insulating layer, a photoconductive layer and a conductive substrate, since the surfacial insulating layer constitutes a complete barrier against the transfer of charge and involves therefore a narrower latitude for the balance of the applied and removed charge for sheet separation than in the two-layered photosensitive member which experiences charge decay in the dark or in the light and the charge transfer effect by the majority charge carrier.

However, the electrostatic separating method combined with the conventional two-layered photosensitive member still has certain drawbacks. One of such drawbacks is the lack of stability in the sheet separation. In fact the sheet separation may become difficult because of a fluctuation in the balance of the amount of charge applied at the image transfer and that of removed charge at the sheet separation, caused, for example, by the presence of light or dark potential on the photosensitive member, presence of a high or low moisture in the atmosphere, or the use of a heavy or light transfer sheet.

Another drawback of the electrostatic separating process utilizing the two-layered photosensitive member is related to the image quality of the final copy obtained on the transfer sheet. In the case that the toner constituting the visible image has a low volume resistivity for example in a range of $10^8$–$10^{10}$ Ω.cm or in case the toner has a small charge for example in a range of 2–5 μC/g, the toner once attracted to the transfer sheet at the image transfer step is returned to the photosensitive member under the effect of an inverse electric field at the sheet separating step, thus only providing a disturbed image with an insufficient density on the final copy. Such phenomenon is generally known as an incomplete image transfer. Such incomplete image transfer tends to appear particularly at the leading end of the image where the sheet separation is initiated. This fact is therefore well known as the leading end image loss in the electrostatic sheet separating method.

FIGS. 1A and 1B show the position of the transfer sheet with respect to the photosensitive member respectively at the start of and in the course of sheet separating step, wherein shown are a two-layered photosensitive member 1, a visible image 2, a transfer charger 3, and a separating charger 4. At the start of the sheet separating step, a leading end portion of a transfer sheet P, having no preceding paper, is subjected to charge elimination for sheet separation while it is adhered to the drum 1 and is therefore separated therefrom at a point α which is relatively deep in the charge eliminating area. Such sheet separation gives rise to an incomplete image transfer. In a succeeding portion b, as shown in FIG. 1B, the sheet P is separated from the drum 1 at a point β close to the entrance of the charge eliminating area because of the weight of the already separated sheet portion. Consequently the transfer sheet P is separated from the drum 1 during the charge elimination, maintaining a satisfactory image on the final copy. Such image loss at the leading end is encountered particularly in a transfer sheet of low rigidity or of low weight.

The incomplete image transfer and the image loss at the leading end explained above tend to appear when the toner constituting the visible image retains a small amount of charge. Since the Coulomb force generated by the charge retained by the toner and by the charge applied to the transfer sheet at the image transfer is responsible for forming a regular arrangement of the toner on the transfer sheet, a smaller charge on the toner not only reduces the efficiency of image transfer but also reduces the force anchoring the transferred toner on the transfer sheet, thus promoting the disturbance in the image and the image loss at the leading end in the electrostatic sheet separating method because of the presence of an inverse electric field repelling the toner from the transfer sheet at the charge eliminating step. A series of experiments conducted by the inventors has proved that the two-layered photosensitive members, particularly the widely used ones based on selenium or zinc oxide, are essentially unfavorable with respect to the amount of charge retained by the toner and to the application of an electric field at the charge eliminating step in the electrostatic sheet separating method because of the following reasons:

(1) In a two-layered photosensitive member, the charge retained by the toner is of the polarity opposite to that of the majority carriers in the photosensitive layer, so that the photosensitive member functions as a conductor to the toner, thus inevitably attenuating the charge on the toner. Such phenomenon becomes particularly apparent in relatively conductive toner, having a specific resistivity in a range of $10^8$–$10^{10}$ Ω.cm.

(2) In the electrostatic separating method, the charge applied at the image transfer is of the same polarity as that of the majority carrier in the photosensitive layer but the charge applied at the sheet separation is of the opposite polarity. This fact suggests that the photosensitive member functions as an insulator at the image transfer step but as a conductor at the sheet separating step. Consequently the transfer sheet is placed in a relatively strong electric field by the conductive nature of the photosensitive member, particularly at the leading end portion of the image, so that the once transferred toner tends to return to the photosensitive member.

The above-mentioned phenomenon (1) is related to the attenuating time of the charge of the toner and becomes apparent in a relatively slow process, while the phenomenon (2) becomes apparent in a high-speed process in which the image transfer and the sheet separation are both conducted under strong electric fields.

SUMMARY OF THE INVENTION

The object of the present invention is to provide an electrophotographic process capable of conducting stable electrostatic sheet separation with a three-layered photosensitive member having a surface insulating layer.

Another object of the present invention is to provide an electrophotographic process and an apparatus therefor, utilizing a novel electrostatic separating mechanism superior to that used in combination with a two-layered photosensitive member.

Still another object of the present invention is to provide an electrophotographic process and an apparatus therefor, utilizing an electrostatic separating method with a constant-current image transfer and with a constant-current or constant current differential sheet separation and capable of achieving stable sheet separation with an improved transfer efficiency of toner.

Still another object of the present invention is to provide an electrophotographic process and an apparatus therefor, utilizing an electrostatic separating method with a constant-current image transfer and with a constant-current or constant current differential sheet separation and capable of avoiding disturbance of transferred toner on the transfer sheet.

In the use of a three-layered photosensitive member, stable sheet separation requires a strictly defined balance between the charge applied at the image transfer and the charge eliminated at the sheet separation, because of the presence of the surfacial insulating layer. Although a zero potential can be easily attained by light irradiation or by corona charge elimination in a two-layered photosensitive member, it is practically quite difficult to stably maintain a predetermined potential on a three-layered photosensitive member. This is one of the reasons that render the use of electrostatic separating method difficult with a three-layered photosensitive member.

The aforementioned objects can be achieved according to the present invention by a process comprising the steps of forming a visible image of coloring particles on a photosensitive member having a surface insulating layer, providing the visible image with a charge by first corona discharge, subsequently bringing a transfer sheet in contact with the photosensitive member, providing the rear face of the transfer sheet by second corona discharge with a predetermined amount of charge of a polarity opposite to that of the charge retained by the coloring particles thereby transferring the visible image onto the transfer sheet, and providing the rear face of the transfer sheet by third corona discharge with a predetermined amount of charge which is the same in polarity as the charge on the coloring particles but is less in the amount than the charge provided by the second corona discharge, thereby separating the transfer sheet from the photosensitive member.

The present invention therefore enables electrostatic sheet separation without incomplete image transfer or image loss at the leading end, and also allows the use of the electrostatic separating method even in combination with electroconductive toner.

The foregoing and still other objects and advantages of the present invention will be made fully apparent from the following description which is to be read in conjunction with the attached drawings.

DESCRIPTION OF THE PREFERRED EMBODIMENTS

Now the present invention will be clarified in detail by embodiments thereof shown in the attached drawings.

Figure 2:
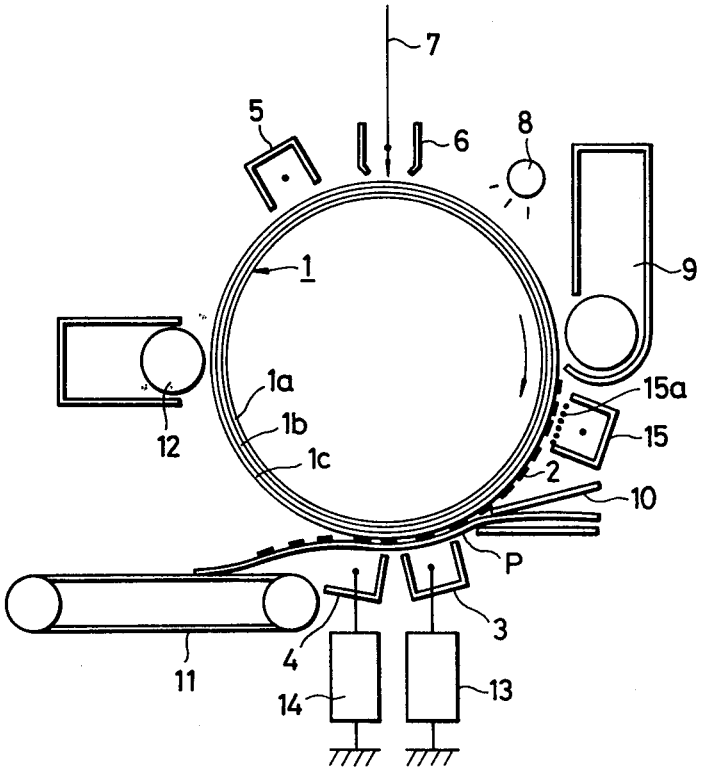
FIG. 2 is a cross-sectional view of an electrophotographic apparatus embodying the present invention.

FIG. 2 is a cross-sectional view of an electrophotographic apparatus embodying the present invention, wherein shown are a three-layered photosensitive drum 1 composed of a conductive substrate 1*a*, an N-type photosensitive layer 1*b* made of CdS-binder system and provided on said substrate, and a surfacial insulating layer 1*c*; a primary corona charger 5 of positive polarity which is opposite to that of the majority carrier of the photosensitive member; an AC corona charger 6; a light beam 7 for imagewise exposure; a flush exposure lamp 8; a developing station 9; a paper guide 10; a transfer corona charger 3; a separating corona charger 4; a transfer sheet P; transport means 11 for the separated transfer sheet P; surface cleaning means 12 for the photosensitive drum 1; power supply sources 13, 14 connected to said transfer corona charger 3 and to said separating corona charger 4; and a pre-transfer charger 15 having a grid 15*a* for charging a visible toner image 2 formed by a developing step on the photosensitive drum 1. The polarity of the charge given to the visible toner image by said pre-transfer charger 15 may be the same as or different from that of the charge retained by the toner in the developing step, and the grid potential can also be arbitrarily selected. These facts are detailedly described in the U.S. patent application Ser. No. 191,030, now U.S. Pat. No. 4,422,591, issued Sept. 6, 1983, and commonly assigned herewith. The charge given to the rear face of the transfer sheet by the transfer charger 3 is of a polarity opposite to that of the toner after pre-transfer charging, and the charge given to the rear face of the transfer sheet by the separating charger 4 is of a polarity opposite to that of the charge given in the transfer step. The power supply sources 13, 14 for corona chargers may be of DC or AC type, as long as the charge given to the visible toner image or the rear face of transfer sheet in the charging or charge eliminating step has an appropriate polarity. In the following there will be given an explanation on the function of the aforementioned components.

The three-layered photosensitive member 1, having the surfacial insulating layer 1c, bears the visible toner image formed thereon in a state electrically insulated from the ground potential. Such situation is quite different from what is encountered in the conventional N- or P-type two-layered photosensitive member which is conductive to the visible toner image formed thereon. Consequently the charge of the visible toner image 2 formed on a three-layered photosensitive member is not neutralized by the majority carriers in the photoconductive layer. This fact indicates that the visible toner image on a three-layered photosensitive member can retain the charge given by the pre-transfer charging and bring it to the image transfer step, while such charge inevitably leaks in a two-layered photosensitive member. In this manner the pre-transfer charging is very effective in improving the transfer efficiency and preventing the image disturbance at the electrostatic sheet separation, particularly when conductive toner is employed. Also in a two-layered photosensitive member, a charge of an opposite polarity to that of the majority carrier in the photoconductive layer tends to leak therethrough and is not easily retained by the visible toner image, but a three-layered photosensitive member, having a surfacial insulating layer, is capable of retaining the charges regardless of the polarity. This fact provides the advantage of permitting arbitrary selection of the polarity of corona discharge, for example in case the ozone generation from corona charger has to be minimized, as positive corona discharge tends to generate more ozone than in negative corona discharge.

The pre-transfer charger 15 provides the visible toner image 2 with a charge of a predetermined polarity. Thus a first function of the pre-transfer charging is to increase the amount of charge retained by the toner, since a low charge amount on the toner tends to give rise to incomplete image transfer, image loss at the leading end and image disturbance in the charge eliminating step in the electrostatic sheet separating method. The charge given to the visible toner image 2 is satisfactorily retained to the image transfer step, owing to the presence of the surfacial insulating layer in the photosensitive member 1.

A second function of the pre-transfer charger 15 is to reduce or dissipate the difference between the surface potentials of the non-image area and of the visible image area, in order to avoid an excessive distribution of the image transferring current to the non-image area, which will cause an insufficient current in the visible image area, in the succeeding image transfer step.

The transfer charger 3 is provided with an insulating shield or a conductive shield insulated in the internal surface and is connected to the power supply source 13 of a constant current or a constant current difference to provide the rear face of the transfer sheet with a charge of a predetermined amount (A). Said amount (A) is preferably selected within a range not causing a breakdown in the transfer sheet, as described in U.S. patent application Ser. No. 184,663, now U.S. Pat. No. 4,341,457, issued July 27, 1982 and commonly assigned herewith. In this manner the amount of charge given to the rear face of the transfer sheet is made constant regardless of the surface potential of the transfer sheet or of the ambient conditions, significantly contributing to stable sheet separation.

The separating charger 14, similarly provided with an insulating shield or a conductive shield insulated in the internal surface, is connected to the power supply source 14 of a constant current or a preferably a constant current difference to provide the rear face of the transfer sheet with a charge of a polarity substantially opposite to that of the charge given to the rear face at the image transfer and of an amount (B) smaller than that of said charge given at the image transfer ($B \leqq A$). In this manner the charge retained on the rear face of the transfer sheet, functioning to maintain the same on the photosensitive drum 1, is removed, leaving only an amount ($A-B$) which is approximately equal to the charge retained by the toner and thus causing the separation of the transfer sheet. The lines of electric force emanating from the charge which is retained at the rear face and is approximately equal in the amount to the charge retained by the toner are substantially confined within a condenser formed by the transfer sheet, whereby said sheet is no longer adhered to the photosensitive member 1 and can be separated therefrom by the weight or rigidity of said sheet.

Also let us consider the effect of the electric field acting on the toner at the sheet separation. On the photosensitive member 1 the charge elimination is conducted across the surfacial insulating layer in contrast to the case of two-layered photosensitive member which functions as a conductor at the sheet separating step, so that the repulsive force exerted by the drum 1 on the toner is advantageously reduced, under the effect of said electric field, compared to the case of a two-layered photosensitive member. Furthermore, on an N-type photosensitive layer for example, the toner generally assumes a negative charge. However, in the electrostatic separating method with a positive charging at the image transfer and with a negative charging at the sheet separation, the photosensitive layer becomes insulating at the separating step, thereby preventing the strong electric field in cooperation with the surfacial insulating layer.

Table 1 shows an example of the charges to be given to the visible toner image 2 and to the transfer sheet in the aforementioned process. Such electrostatic separating process enables satisfactory image transfer without incomplete transfer, image loss at the leading end or image disturbance and also ensures satisfactory separation of the transfer sheet from the photosensitive member for a wide range of volume resistivity of the toner from $10^8$ to $10^{15}$ Ω.cm.

TABLE 1

| | | |
|---|---|---|
| Charge on toner | During development | $-5.0\ \mu C/g$ |
| | After pre-transfer charging | $-20.0$ |
| Charge given at image transfer | | $+4.2 \times 10^{-2}\ \mu C/cm^3$ |
| Charge given at sheet separation | | $-3.5 \times 10^{-2}$ |
| Charge on toner on final copy | | $-1.7 \times 10^{-3}\ \mu C/cm^3$ |

TABLE 1-continued

| | |
|---|---|
| Charge on rear face of final copy | $+7.0 \times 10^{-3}$ |

Figure 1A:
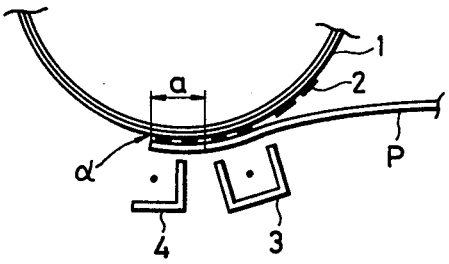
FIG. 1A is a schematic view showing the positional relationship of a transfer sheet with respect to a photosensitive member at the start of the sheet separating step.
Figure 1B:
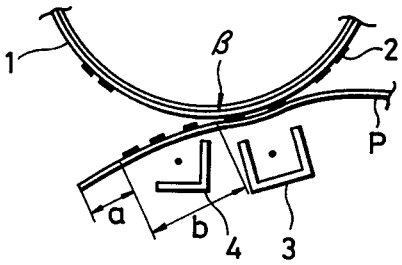
FIG. 1B is a similar schematic view showing the state in the course of the sheet separating step.

The above-mentioned electrostatic separating method may still show unstable sheet separation, incomplete image transfer or image loss at the leading end for a transfer sheet of low weight or low rigidity. Such drawback can be avoided by a second embodiment of the present invention shown in FIG. 3, wherein the components already explained are represented by the same numbers as before. In the present embodiment there is provided an air-blowing pipe 16 for blowing a constant air stream along the photosensitive member 1. A rigid or heavy transfer sheet is separated, even at the leading end thereof, from the photosensitive member at a point $\beta$ shown in FIG. 1B, but a lighter or softer transfer sheet may not be successfully separated even when the charge elimination is conducted completely. Stated differently, when the transfer sheet is in intimate contact with the drum 1, sheet separation by gravity is not possible even in the absence of electrical attractive force. More specifically, a negative pressure will be generated between the leading end of the transfer sheet and the photosensitive drum 1 at the start of separation, and the sheet separation will be made possible only when a certain external force applied to the transfer sheet exceeds said negative pressure. The above-mentioned weight or rigidity of the transfer sheet functions as such external force, and the sheet separation becomes unstable if such external force is insufficient.

Figure 3:
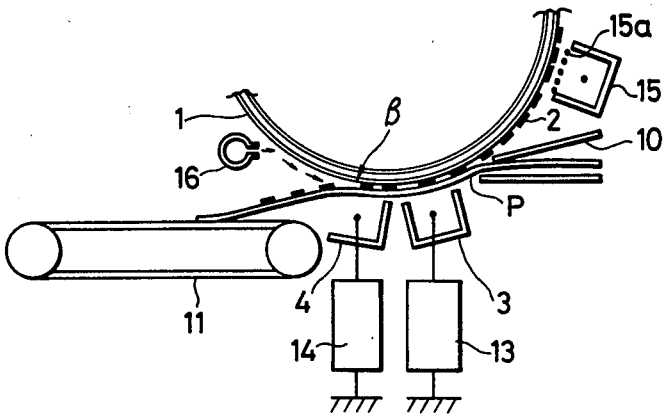
FIG. 3 is a cross-sectional view of an electrophotographic apparatus representing another embodiment of the present invention.

The air-blowing pipe 16 shown in FIG. 3 is intended to provide such external force, by blowing air in such a manner as to separate the leading end of the transfer sheet at the point $\beta$ in the vicinity of the separating area. Such external force for separating the transfer sheet, particularly the leading end thereof, from the photosensitive member 1 may also be applied by a mechanical finger or by air suction. However the separation by air blowing is superior to the air suction from the rear face of the transfer sheet since the transfer sheet should be maintained separate from the photosensitive member 1 in a step of providing the transfer sheet with a charge of a polarity same as that of the charge retained by the toner. Also said air blowing method is superior to the use of a mechanical finger because of the absence of mechanical contact with the photosensitive member of the transfer sheet.

EXAMPLE

In an electrophotographic process conducted with a photosensitive drum 1 of a diameter 180 mm rotated at a peripheral speed of 400 mm/sec, a transfer sheet of a weight of 45 g/m$^2$ often showed unstable separation, incomplete image transfer, image loss at the leading end and image disturbance, but a constant air stream of a speed of 1–2 m/s blown to the separating area enabled satisfactory image transfer and sheet separation. Said air blowing pipe 16 may be provided with plural blowing apertures positioned parallel to the axis of the photosensitive drum, or may be provided with an oblong slit-shaped aperture. Said apertures are preferably so positioned as to blow an air stream toward the photosensitive member, thereby causing an air stream to the separating area along the surface of the photosensitive member. Also there may be additionally provided appropriate guide plates.

Figure 4:
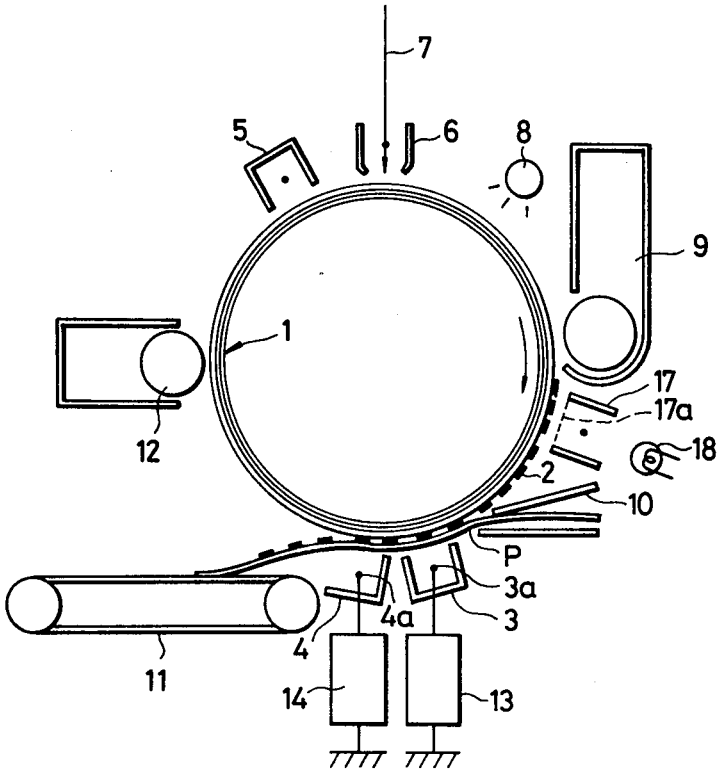
FIG. 4 is a cross-sectional view of an electrophotographic apparatus representing still another embodiment of the present invention.

FIG. 4 shows still another embodiment of the present invention, wherein the same components as those in FIG. 2 are represented by the same numbers. There are further provided a pre-transfer charger 17 having a grid 17*a* for allowing a light exposure simultaneous with the charging, and a flush exposure lamp 18 positioned behind said pre-transfer charger. Such flush exposure conducted in the pre-transfer charging shifts the surface potential of the visible image area 2 to a state providing an improved transfer efficiency. Another important effect of such flush exposure is to prevent corona discharge in the dark of a polarity the same as that of the majority carrier in the photosensitive layer, as such corona discharge is known as a cause of fatigue in the three-layered photosensitive member.

As explained in the foregoing, the present invention enables satisfactory electrostatic sheet separation without incomplete image transfer or image loss at the leading end, even when the toner retains a relatively small charge or when a soft or light-weight transfer sheet has to be used.

Conventionally, the electrostatic separating method has been plagued by unstable separation, caused by the fluctuation in the surface potential of the photosensitive member or by changes in the ambient conditions. In order to avoid such instability, there has already been disclosed, in commonly assigned U.S. Pat. No. 4,341,457, a separating method with a constant-current image transfer and with a constant-current or constant current difference, wherein a predetermined amount of charge is given at the image transfer and another predetermined amount of charge is given also at the sheet separation.

Such constant-current image transfer is still associated, however, with certain defects which will be explained in the following.

In the image transfer with a corona discharge through a constant-current source instead of a conventional corona discharge through a constant-voltage source, the charge given to the rear face of the transfer sheet is controlled to a predetermined amount. Consequently the attractive force between the transfer sheet and the photosensitive member is suppressed, thus facilitating the sheet separation. On the other hand, the transfer efficiency is often deteriorated because the amount of charge present on the rear face of the transfer sheet is larger in areas corresponding to the toner image areas than in areas corresponding to the non-image areas, as the surface potential of the photosensitive member in the toner image areas is of the same polarity as that of the voltage applied to the transfer corona charger and is higher than in the non-image areas.

Such constant-current image transfer, when combined with the electrostatic sheet separation, will result not only in the above-mentioned insufficient transfer efficiency but also in frequent disturbance of toner image on the transfer sheet, although the sheet separation itself is well stabilized. Such image disturbance is caused by the electric field generated by the separating corona discharge, if it is too strong even under a constant-current condition, or by a mechanical shock to the transfer sheet during the transportation thereof after the sheet separation, or by a mechanical pressure applied to the transfer sheet in the fixation of the toner image onto the sheet.

Such drawbacks encountered in combination with the electrostatic separation are derived from the control of the currents for image transfer and sheet separation.

More specifically, after the charge elimination of a predetermined amount by the separating corona discharge, the charge present on the rear face of the transfer sheet corresponding to the toner image areas is substantially comparable to the charge retained by the toner itself, so that the attractive force exerted by the sheet on the toner is far smaller than in the conventional sheet separation with separating belts. It will also be understood that said attractive force is made smaller in the aforementioned method with a constant-current image transfer and with a constant-current sheet separation wherein a charge approximately equal to the charge on toner is intentionally give to the rear face of the transfer sheet, even in comparison with a case of no particular control on the currents for image transfer and sheet separation.

The above-mentioned drawbacks are also caused by the small charge retained by the toner itself. The attractive force acting on the toner is governed by the charge retained by the toner itself even when a larger charge is present on the rear face of the transfer sheet, so that the toner is only weakly attracted by the sheet when the toner retains a small charge.

Additional objects of the present invention are to improve the transfer efficiency of toner while maintaining stable sheet separation and to prevent disturbance of transferred toner on the transfer sheet, in the electrostatic separating method with a constant-current image transfer and with a constant-current or constant current difference sheet separation.

These objects are achieved by still another embodiment of the present invention shown in FIG. 4, wherein shown are a three-layered photosensitive drum 1 comprising an N-type CdS-binder photosensitive layer; a primary charger 5; a secondary corona charger 6 for conducting the charge elimination of said drum 1 simultaneously with an imagewise irradiation 7; a flush exposure lamp 8; a developing station 9; a first charger 17 after the development; and a flush exposure lamp 18 for irradiating the surface of the photosensitive drum 1 having a visible toner image thereon simultaneously with a corona discharge.

Figure 5A:
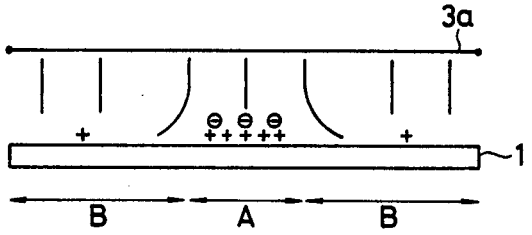
FIGS. 5A and 5B are schematic views showing charged states of a three-layered photosensitive member.
Figure 5B:
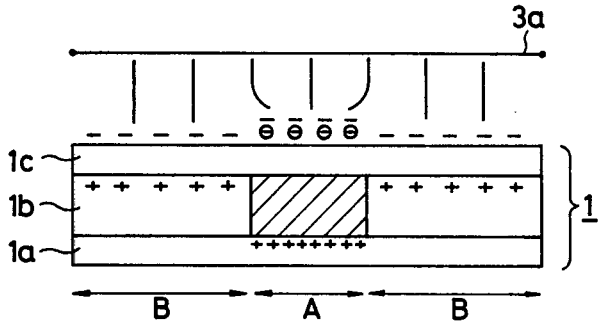

The present embodiment, if without the first charge 17 after development, may result in incomplete image transfer since the transferring charge in the image transfer step is not easily accepted in the toner image areas (A) as shown in FIG. 5A. FIG. 5B shows the state of the photosensitive member 1 when the charge of a same polarity as that of the toner is applied by said first charger 17 simultaneously with a flush exposure by the lamp 18. The photoconductive layer 1*b* remains insulating in the toner image area (A) as the light of said lamp 18 is intercepted by the toner, but it becomes conductive in the non-image area (B) by said light, thus providing a charge distribution as illustrated. Thus, in the toner image area (A), the insulating photosensitive layer reduces the electrostatic capacitance, thus generating a higher surface potential in the non-image area (B) than in the toner image area (A). Consequently, in the image transfer step, the transferring charge is concentrated in the toner image area (A) to improve the transfer efficiency.

Table 2 shows an example of surface potentials achieved in a process including a charging with the first charger 17 of a same polarity as that of the charge on the toner simultaneous with a flush exposure by the lamp 18, in comparison with the potential obtained in a process not including such steps. The image disturbance on the transfer sheet at or after the separation thereof can be completely avoided by the apparatus shown in FIG. 4, but such image disturbance becomes significant if the first charger after development is absent.

TABLE 2

| Surface potential | Toner image area (A) | Non-image area (B) |
|---|---|---|
| With first charger 17 and flush exposure 18 | −140 V | −70 V |
| Without first charger 17 and flush exposure 18 | +230 V | +50 V |

Although in the foregoing embodiment the flush exposure by the lamp 18 after the development is simultaneously given with the corona discharge by the first charger 17, a similar effect can be obtained also when said flush exposure is given prior to said corona discharge.

It is to be further noted that the present invention is applicable also to so-called Carlson's electrophotographic process utilizing a two-layered photosensitive member and an apparatus therefor.

Figure 6:
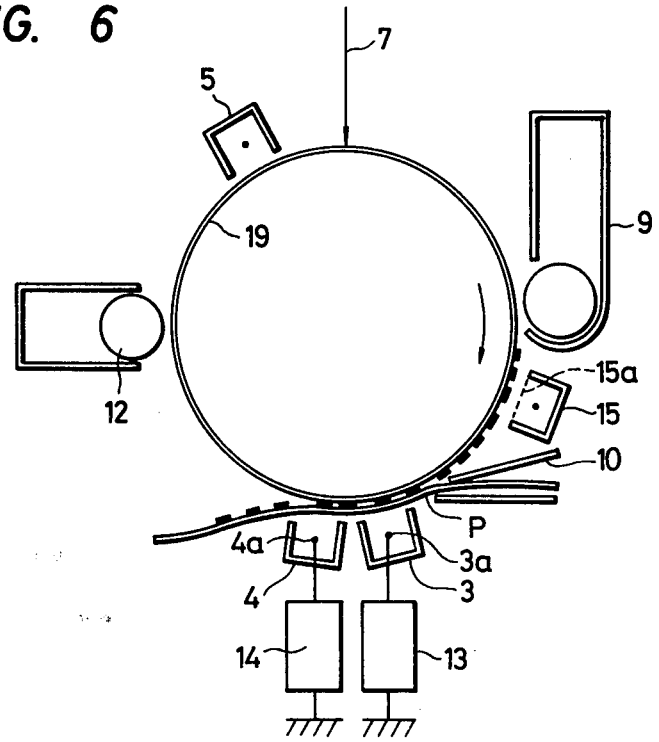
FIG. 6 is a cross-sectional view of an electrophotographic apparatus representing still another embodiment of the present invention.

FIG. 6 shows still another embodiment of the present invention, wherein shown are a two-layered P-type selenium photosensitive drum 19; a charger 5 for uniformly charging said drum; an imagewise irradiation 7; the developing station 9; a first post-development charger 15; a transfer sheet guide 10; a second post-development charger 3; a third post-development charger 4; a cleaner 12; and a transfer sheet P. The photosensitive drum 19, rotated in a direction of arrow, is at first uniformly charged by the charger 5 and is then subjected to the imagewise irradiation 7 to form an electrostatic latent image, which is subsequently rendered visible by the developing station 9. The visible image thus obtained is transferred, by the function of the first and second post-development chargers 15, 3, onto the transfer sheet P which is guided by the sheet guide 10 and is subsequently separated from the photosensitive drum 19 by the function of the third charger 4. Thereafter the photosensitive drum 19 is cleaned by the cleaner 12 and reaches the charger 5 to repeat the copying process.

The second and third post-development chargers 3, 4 constitute a device for effecting the electrostatic separation disclosed by the present applicant in the aforementioned U.S. Pat. No. 4,341,457. The second post-development charger 3 is preferably provided with an insulating shield, and the discharger wire 3*a* thereof is connected with DC high-voltage source 13 with a constant current performance, while the third post-development charger 4 is preferably provided with an insulating shield and the discharge wire 4*a* thereof is connected with an AC high-voltage source 14 with a constant current difference performance. Consequently the charges given to the transfer sheet P are well controlled constant not only in the DC corona discharge by the second charger 3 but also in the AC corona discharge by the third charger 4. The first post-development charger 15 constitutes the essential component in the electrostatic separation according to the present invention, of which performance will hereafter be explained with reference to FIG. 7.

Figure 7A:
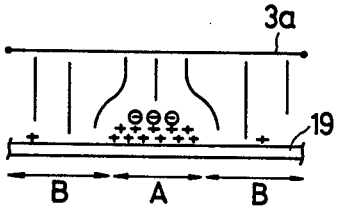
FIGS. 7A, 7B, 7C and 7D are schematic views showing states of corona discharge by a second charger.
Figure 7B:
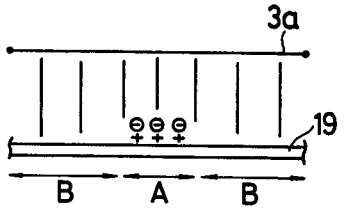
Figure 7C:
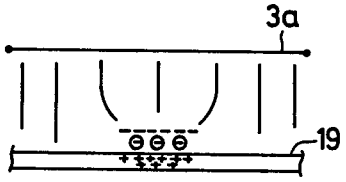

FIGS. 7A–7C illustrate the corona discharge by the second post-development charger 3, wherein FIG. 7A shows a state in a conventional process without the first charger 15, while FIGS. 7B and 7C show states of the process of the present invention with said charger 15.

The second charger 3 is provided for transferring the visible image onto the transfer sheet P, but the sheet usually present between the discharge wire 3*a* and the photosensitive drum 19 is omitted in the illustration for the purpose of simplicity.

In case of FIG. 7A, the image area (A) still retains the potential of the latent image even after the image development, so that the charge from the discharge wire 3*a*, which is in polarity opposite to that of the charge on the toner and the same as that of the latent image potential, is not easily accepted in the image area (A) but is more distributed in the non-image area (B). This is due to to fact that the potential difference between the discharge wire 3*a* and the photosensitive member 19 is larger in the non-image area (B) than in the image area (A). In the use of a constant-voltage supply for the discharge wire 3*a*, the current to the image area (A) is primarily predetermined by the surface potential in said area (A) and the voltage supplied to the discharge wire 3*a* since the current of corona discharge is not limited. However in the use of a constant current for image transfer for the purpose of stabilizing the electrostatic separation, the amount of charge given to the image area (A) is influenced by that given to the non-image area (B) as the entire corona current is limited, and the current to the non-image area (B) becomes larger if such non-image area represents a larger proportion, eventually giving an insufficient charge to the image area (A) which in fact requires such charge for image transfer. Such phenomenon becomes more apparent particularly when the corona discharge is so limited as not to cause a breakdown in the transfer sheet for the purpose of achieving stable electrostatic separation.

The above-mentioned drawback can be prevented, as shown in FIG. 7B, by the first charger 15, which provides the photosensitive drum 19 after image development with a charge of the same polarity as that of the charge on the toner, thereby reducing the difference in the surface potential between the image area (A) and the non-image area (B) to a level substantially not affecting the image transfer. For such purpose, the first post-development charger 15 is preferably composed of a corotron having a grid 15*a*. With such arrangement, the image area (A) no longer has the electric field repulsive to the corona ions emitted in the image transfer step by the second post-development charger 3, so that the transfer efficiency is improved. Also FIG. 7C shows a state in which the first post-development charger 15 continues to provide the charge of a polarity the same as that of the charge on the toner even after the above-mentioned potential levelling effect is achieved. This can be achieved in practice by increasing the voltage supplied to the discharge wire or by regulating a bias voltage supplied to the grid 15*a*. The toner in the image area (A) is given a charge of a polarity same as that of the toner because the P-type selenium photosensitive member is not charged negatively. Consequently the surface potential of the image area (A) is eventually inverted to a polarity opposite to that of the original latent image, so that the transfer efficiency is further improved by a concentrated charge flow to the image area (A) in the image transfer step by the second post-development charger 3. Table 3 shows the transfer efficiencies achieved corresponding to the cases shown in FIG. 7.

TABLE 3

| | FIG. 7A | FIG. 7B | FIG. 7C |
|---|---|---|---|
| Transfer efficiency | 60% | 90% | 95% |

The first post-development charger 15 of the present invention, when used in the electrostatic separating method with a constant-current image transfer and with a constant-current or constant current difference sheet separation, provides the advantage of preventing the image disturbance on the transfer sheet, in addition to the above-mentioned improvement in the transfer efficiency. This additional advantage is derived from the fact that the corona discharge from the first post-development charger 15 for levelling the surface potential applies corona ions to the toner, thus increasing the charge thereof and thereby achieving an additional stabilization.

Following Table 4 shows an example of the charge present on the rear face of the transfer sheet P after separation, and the charge retained by a solid-black visible image with or without the corona discharge by the first post-development charger 15, in the electrostatic separation with a constant-current image transfer and with a constant-current or constant-current difference sheet separation. The image obtained without said charger 15 is hardly considered acceptable as it is mostly smeared in the sheet separating step or in the subsequent transporting or fixing step, but such image disturbance can be satisfactorily prevented by the use of said first charger 15.

Such image disturbance is observed particularly in the case that the amount of charge given to the transfer sheet in the image transfer step is limited and the development is conducted with one-component toner instead of the conventional two-component toner, since the charge present on the rear face of the transfer sheet for attracting the toner is limited almost to the necessary minimum and the toner only has a relatively small charge. In such case, therefore, it is essential to increase the charge on the toner by the corona discharge with the first post-development corona charger.

TABLE 4

| | |
|---|---|
| Charge on rear face of transfer sheet | $+14.6 \times 10^{-9}$ C/cm$^2$ |
| With first charger 15 | $-18.4 \times 10^{-9}$ C/cm$^2$ |
| Without first charger 15 | $-3.3 \times 10^{-9}$ C/cm$^2$ |

Figure 7D:
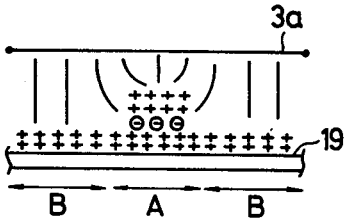

Now, in contrast to the embodiment shown in FIG. 6 wherein the first post-development charger 15 provides a corona discharge of a polarity the same as that of the charge retained by the toner, FIG. 7D shows a state of transfer step in which a corona discharge of a polarity opposite to that of the charge of toner to invert the polarity thereof. In such case, the discharge wire 3*a* of the second post-development charger 3 is given a voltage of a polarity opposite to that of the toner after polarity inversion. In this case the surface potential becomes higher in the image area (A) than in the non-image area (B), so that the transferring charge is concentrated in the image area (A) to likewise improve the transfer efficiency. Also the charge on the toner is inverted and stabilized to prevent the image disturbance as explained above.

Figure 8:
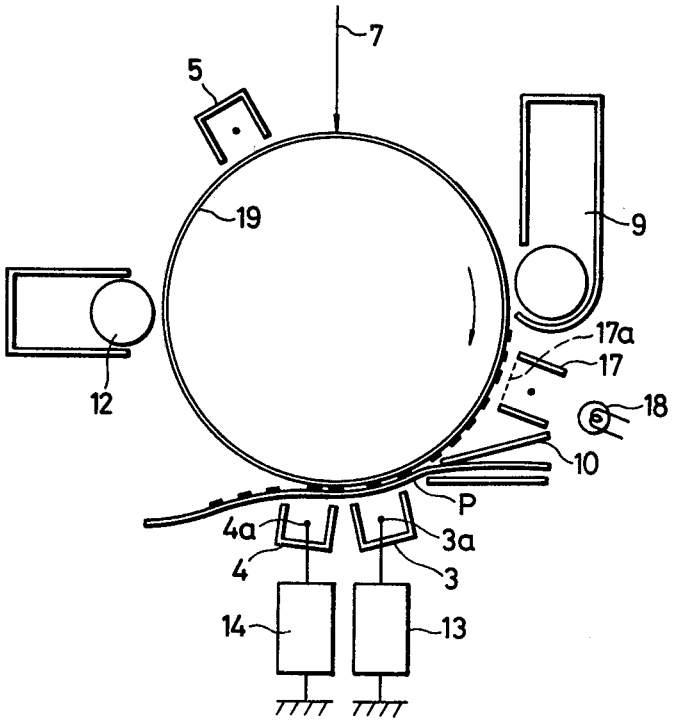
FIG. 8 is a cross-sectional view of an electrophotographic apparatus representing still another embodiment of the present invention.

Furthermore, as shown in FIG. 8, the use of a flush exposure simultaneous with, or before or after the corona discharge by the first charger 17 is effective in improving the transfer efficiency through the levelling of the surface potential, also in combination with a two-layered photosensitive member.

The present invention is by no means limited to the foregoing embodiments and combinations easily derivable therefrom. As detailedly explained in the foregoing, the present invention achieves electrostatic sheet separation in a stable manner with an improved transfer efficiency and without disturbance in the transferred image.

What we claim is:

1. An electrophotographic apparatus comprising:

means for bearing a visible image composed of coloring particles, the visible image bearing means comprising a conductive base, a photosensitive layer and an insulating surface layer;

means for causing a first corona discharge for providing the coloring particles constituting the visible image with a charge of a first polarity;

means for bringing the visible image bearing means in contact with a transfer sheet;

means for providing the rear face of the transfer sheet by means of a second corona discharge with a charge of a polarity opposite to that of the charge applied by means of the first corona discharge for transferring the visible image onto the transfer sheet; and means for providing the rear face of the transfer sheet by means of a third corona discharge with a charge of a polarity which is the same as that of the charge applied by means of the first corona discharge to separate the transfer sheet from the visible image bearing means.

2. An electrophotographic apparatus according to claim 1, further comprising means for blowing a constant air stream toward the leading end of the transfer sheet simultaneously with the charging by the third corona discharge means.

3. An electrophotographic apparatus according to claim 1, further comprising means for subjecting the visible image bearing image to a flush light exposure simultaneously with the charging by the first corona discharge means.

4. An electrophotographic apparatus according to claim 1, 2, or 3, wherein the first corona discharge means has a discharge aperture and comprises a grid at the discharge aperture.

5. An electrophotographic apparatus according to claim 1, wherein the visible image bearing means is a two-layered photosensitive member comprising a conductive substrate and a photoconductive layer.

6. An electrophotographic apparatus according to claim 5, further comprising means for subjecting the visible image bearing means to a flush light exposure simultaneously with or prior to the first corona discharge.

7. An electrophotographic apparatus according to claim 5, wherein the first corona discharge means has a discharge aperture and comprises a grid at the discharge aperture.

8. An electrophotographic process comprising the steps of forming an image area of coloring particles on a photosensitive member having a surface insulating layer, applying a first corona discharge to the photosensitive member to reduce the potential difference between the image area and non-image area of the photosensitive member and to vary the reduced potential difference within positive and negative potential regions, subsequently bringing a transfer sheet in contact with the photosensitive member, providing the rear face of the transfer sheet by a second corona discharge with a predetermined amount of charge of a polarity opposite to that of the first corona discharge to transfer the image onto the transfer sheet, and providing the rear face of the transfer sheet by a third corona discharge with a predetermined amount of charge which is the same in polarity as the charge provided by the first corona discharge but is less in amount than the charge provided by the second corona discharge to separate the transfer sheet from the photosensitive member.

9. An electrophotographic process according to claim 6, wherein the photosensitive member is a three-layered photosensitive member comprising a conductive substrate, a photoconductive layer and a surface insulating layer.

10. An electrophotographic process according to claim 6, wherein a constant air stream is blown toward the leading end of the transfer sheet simultaneously with the third corona discharge.

11. An electrophotographic process according to claim 6, wherein the photosensitive member is subjected to a flush light exposure simultaneously with charging by the first corona discharge.

12. An electrophotographic process according to claim 6, 9, 10 or 11, wherein the first corona discharge is carried out by means of a charger having a discharge aperture and a grid at the discharge aperture.

13. An electrophotographic process comprising the steps of forming an image area of developer particles on an insulative surface layer of an image bearing member, applying a first corona discharge to the image bearing member to reduce the potential difference between the image area and non-image area and to vary the reduced potential difference within positive and negative potential regions, bringing a transfer sheet in contact with the developer particles, providing a side of the transfer sheet not in contact with the image bearing member with a predetermined amount of charge of a polarity opposite to that of the charge applied by the first corona discharge by a second corona discharge, and providing a side of the transfer sheet not in contact with the image bearing member with a predetermined amount of charge, by a third corona discharge, which is opposite in polarity to and is less in amount than the charge provided by the second corona discharge, to separate the transfer sheet from the image bearing member.

14. An electrophotographic process comprising the steps of forming an image area of developer particles on an insulative surface layer of a photosensitive member, applying a first corona discharge to the image bearing member to reduce the potential difference between the image area and non-image area of the image bearing member and to vary the reduced potential difference within positive and negative potential regions, bringing a transfer sheet in contact with the developer particles, providing a side of the transfer sheet not in contact with the photosensitive member with a predetermined amount of charge of a polarity opposite to that of the charge imparted by the first corona discharge, by means of a second corona discharge, and providing a side of the transfer sheet not in contact with the photosensitive member with a predetermined amount of charge, by a third corona discharge, which is opposite in polarity to and is less in amount than the charge provided by the second corona discharge, to separate the transfer sheet from the photosensitive member.

15. An electrophotographic process according to claim 14, wherein a flush light exposure is provided to the photosensitive member simultaneously with or prior to the first corona discharge.

16. An electrophotographic process according to claim 13 or 14, wherein the first corona discharge is carried out by means of a charger that has a discharge aperture and a grid in the discharge aperture.

* * * * *

UNITED STATES PATENT AND TRADEMARK OFFICE

CERTIFICATE OF CORRECTION

PATENT NO. : 4,482,240

DATED : November 13, 1984

INVENTOR(S) : TSUKASA KUGE, ET AL.

It is certified that error appears in the above-identified patent and that said Letters Patent is hereby corrected as shown below:

On the title page, change "Cella, Harper & Scinto Fitzpatrick" to --Fitzpatrick, Cella, Harper & Scinto--.

Column 1, line 17, "if" should read --is--;
line 65, before "case" insert --the--; after "case" insert --that--.

Column 5, line 2, "Pat. No. 4,422,591" should read --Pat. No. 4,402,591--;
line 44, after "from" insert --the--.

Column 6, line 16, delete "a" (second occurrence).

Column 9, line 13, "give" should read --given--;
line 43, "charge" should read --charger--;
line 65, "a" should read --the--.

Column 11, line 13, "to to" should read --to the--;
line 57, after "polarity" insert --the--.

Column 14, line 13, Claim 9, "6" should read --8--;
line 18, Claim 10, "6" should read --8--;

UNITED STATES PATENT AND TRADEMARK OFFICE

CERTIFICATE OF CORRECTION

PATENT NO. : 4,482,240

DATED : November 13, 1984

INVENTOR(S) : TSUKASA KUGE, ET AL.

It is certified that error appears in the above-identified patent and that said Letters Patent is hereby corrected as shown below:

Column 14, line 22, Claim 11, "6" should read --8--;
line 26, Claim 12, "6" should read --8--.

Signed and Sealed this

*Fourteenth* Day of *January 1986*

[SEAL]

*Attest:*

DONALD J. QUIGG

*Attesting Officer*

*Commissioner of Patents and Trademarks*